US010170848B1

(12) United States Patent
Enger

(10) Patent No.: US 10,170,848 B1
(45) Date of Patent: Jan. 1, 2019

(54) TERMINAL BLOCK LOCKOUT DEVICE

(71) Applicant: Brady Worldwide, Inc., Milwaukee, WI (US)

(72) Inventor: Andrew N. Enger, Muskego, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 15/696,666

(22) Filed: Sep. 6, 2017

(51) Int. Cl.

| | |
|---|---|
| ***H01R 13/44*** | (2006.01) |
| ***H01R 9/22*** | (2006.01) |
| ***H01R 9/24*** | (2006.01) |
| *H01R 13/46* | (2006.01) |
| *H01R 13/60* | (2006.01) |
| *H01R 13/639* | (2006.01) |
| *H01R 33/97* | (2006.01) |
| *H01H 9/28* | (2006.01) |
| *H01H 3/20* | (2006.01) |

(52) U.S. Cl.
CPC ..... *H01R 9/223* (2013.01); *H01R 9/24* (2013.01); *H01H 3/20* (2013.01); *H01H 9/287* (2013.01); *H01H 2223/044* (2013.01); *H01R 13/44* (2013.01); *H01R 13/465* (2013.01); *H01R 13/60* (2013.01); *H01R 13/6397* (2013.01); *H01R 33/97* (2013.01)

(58) Field of Classification Search
CPC ..... H01R 13/44; H01R 13/465; H01R 33/97; H01R 13/6397; H01R 13/60; H01H 2223/044; H01H 9/287; H01H 3/20; H01H 9/00
USPC ..... 439/133, 134, 135; 200/333, 334, 43.19
See application file for complete search history.

(56) References Cited

U.S. PATENT DOCUMENTS

2014/0220802 A1* 8/2014 Bogart ..... H01H 9/00 439/133

* cited by examiner

*Primary Examiner* — Abdullah Riyami
*Assistant Examiner* — Justin Kratt
(74) *Attorney, Agent, or Firm* — Quarles & Brady LLP

(57) ABSTRACT

A lockout device configured to lockout a terminal block. The lockout device includes a pair of sections rotatably coupled to one another in which each of the sections has an upper portion including a corresponding lockout opening and a lower portion for selective reception into the space of an opened terminal block. The sections are rotatable between an opened and closed position. In the opened position, the upper portions are misaligned and the lower portions are aligned to permit at least a portion of the lower portions to be inserted into an opening in an opened terminal block. In the closed position, the lockout openings of the upper portions are aligned to accommodate reception of a lock in the lockout openings to prevent movement away from the closed position and the lower portions are misaligned to prevent removal of the lower portions from the opening in the terminal block.

14 Claims, 9 Drawing Sheets

TERMINAL BLOCK LOCKOUT DEVICE

CROSS-REFERENCE TO RELATED APPLICATION

Not applicable.

STATEMENT OF FEDERALLY SPONSORED RESEARCH OR DEVELOPMENT

Not applicable.

BACKGROUND

This disclosure relates to a lockout device for locking out a terminal block during a lockout procedure.

Machines, equipment, and other systems often contain energy sources that can be potentially hazardous to workers if these energy sources are not properly controlled and maintained. These energy sources may be, as some non-limiting examples, electrical, mechanical, hydraulic, pneumatic, chemical, and/or thermal in nature.

In order to protect workers from these energy sources while using or maintaining the machines or equipment, proper lockout/tagout procedures and practices may be voluntarily adopted or may be required by the Occupational Safety and Health Administration (OSHA). What constitutes appropriate lockout/tagout practices and procedures will largely depend on the specific equipment. Lockout/tagout procedures and practices involve following pre-determined steps or operations in order to disable the machinery or equipment to prevent the release of potentially hazardous energy before the equipment is maintained or to ensure that, when the equipment is placed back into service, workers remain protected from the potentially hazardous energy.

SUMMARY

Disclosed herein is a lockout device is configured to prevent connection between a pair of terminals of a terminal block by insertion into a space of the terminal block when the terminal block is opened. By use of this lockout device, the terminal block cannot be closed again without withdrawal of the device.

According to one aspect, a lockout device is disclosed. The lockout device includes a pair of sections that are rotatably coupled to one another. Each of the sections has an upper portion including a corresponding lockout opening and a lower portion for selective reception into the space of an opened terminal block. The pair of sections are rotatable between an opened position and a closed position. In the opened position, the upper portions are misaligned and the lower portions are aligned to permit at least a portion of the lower portions to be inserted into an opening between the terminal block while the terminal block is opened. In the closed position, the lockout openings of the upper portions are aligned to accommodate reception of a lock in the lockout openings to prevent movement away from the closed position and the lower portions are misaligned to prevent removal of the lower portions from the opening in the terminal block. This can thereby selectively secure or lockout the terminal block.

In some forms, each of the pair of sections may have a corresponding secondary lockout opening. In the closed position, the secondary lockout openings may be aligned with one another.

In some forms, one of the pair of sections may include a hinge rod, the other of the pair of sections may include a hinge-rod cutaway, and the pair of sections may be coupled together by snap-fitting the hinge rod within the hinge-rod cutaway. The hinge rod may include a hinge-rod protrusion, the rotation cutout may include a stop wall, and the rotation cutout may be configured to allow a predetermined amount of rotation of the hinge rod, and the stop wall may be configured to prevent additional rotation of the hinge rod when the hinge-rod protrusion contacts the stop wall. When the hinge-rod protrusion contacts the stop wall, the pair of sections can be in the opened position.

In some forms, the upper portions of the pair of sections may be on one axial end of the lockout device and the lower portions of the pair of sections may be on the other axial end of the lockout device.

In some forms, each of the lower portions may have a profile perpendicular to an axis of rotatable coupling of the pair of portions in which the respective profiles match in shape and size in the opened position. The respective profiles of the lower portions may be matchable in shape and size in the opened position at an axial position between the pair of lower portions. The respective profiles of the lower portions may be elongated to create the locking function when they are misaligned.

In some forms, one of the two lower portions may be on the axial end and the other may be positioned axially adjacent to this lower portion.

In some forms, the upper portion of each of the pair of sections may be fixed in space relative to the respective lower portion of that section.

According to another aspect, a method is disclosed of preventing connection of a pair of terminals of a terminal block when the terminal block is opened using a lockout device. According to this method, one of a pair of sections of the lockout device is related relative to another one of the sections such that respective lower portions of each of the sections are aligned and respective upper portions of each of the sections are misaligned. The aligned lower portions of the lockout device are inserted into a space of the terminal block when the terminal block is opened thereby preventing the connection of the pair of terminals (e.g., by physically preventing the sliding to reconnect the terminals). After insertion, the pair of sections are rotated relative to one another such that lower portions are misaligned with one another and the respective lockout openings in respective upper portions of each of the pair of sections are aligned with one another to accommodate reception of a lock through the respective pair of lockout openings. By locking the lockout device in this closed position, the lockout device is prevented from being withdrawn from the space in the terminal block due to misalignment of the lower portions.

In some forms, the method may further include inserting a lock through both of the aligned lockout openings, thereby locking the lower portions in a misaligned state relative to one another and preventing rotation of the pair of sections relative to one another. Upon completion of whatever task is being performed requiring the lockout, this lock may be removed and the sections rotated again relative to one another so the lower portions are aligned and can be withdrawn from the space in the terminal block, thereby permitting the terminal block to be closed or connected again.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1:
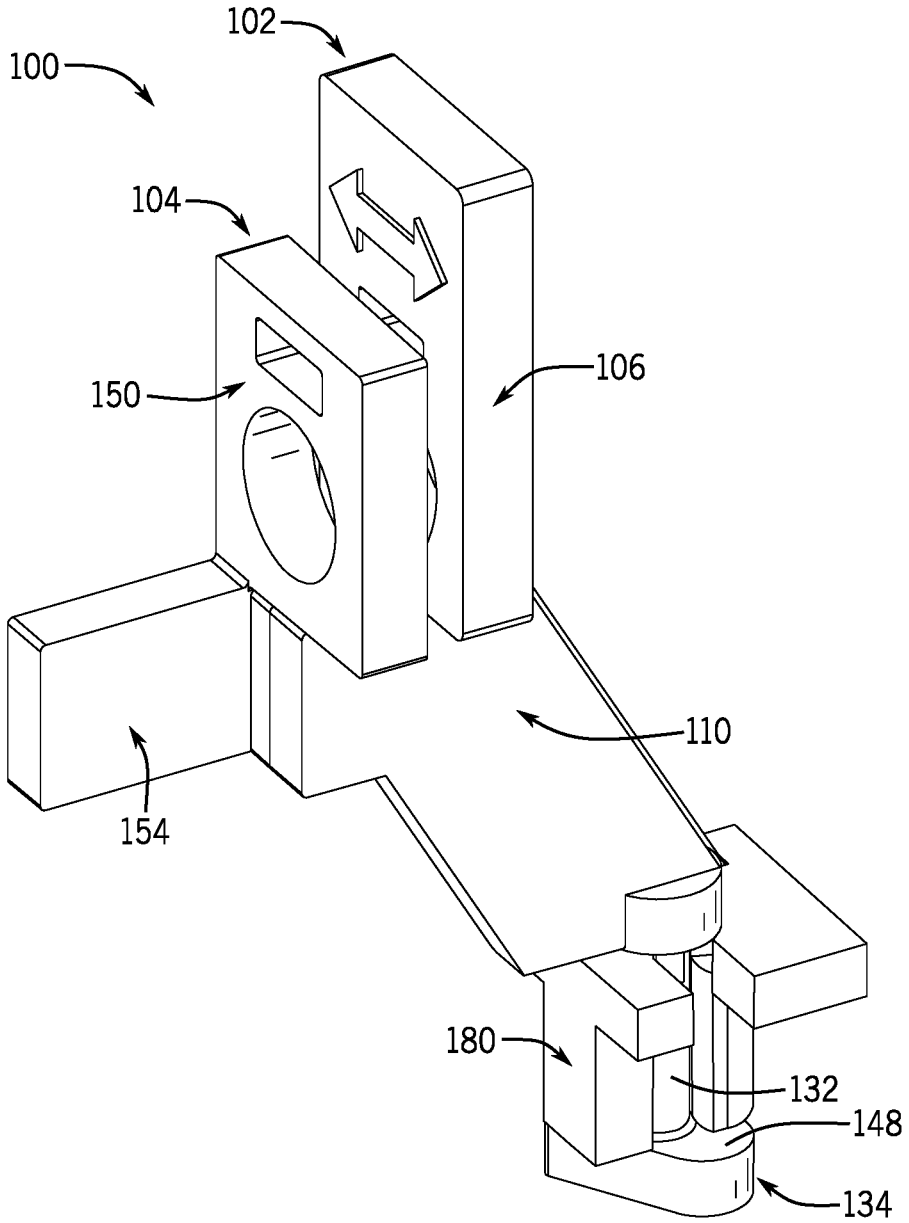
FIG. 1 is a front, top, right perspective view of a lockout device.

Referring first to FIG. 1, a lockout device 100 is illustrated. The lockout device 100 can be used to prevent an electrical connection between a first terminal and a second terminal within a terminal block, typically during a lockout procedure, such as when maintenance is being performed on a larger piece of equipment. However, the use of the lockout device 100 is not solely restricted to that use case.

At a high level, the lockout device 100 includes a pair of lockout sections, including a first lockout section 102 and a second lockout section 104, rotatably coupled to one another. The pair of lockout sections are rotatable between a first open position (shown in FIG. 4) and a second closed position (shown in FIGS. 1 and 5). In the first position, the lockout device 100 is configured to be inserted into a terminal block, between a first terminal and a second terminal. In the second position, the lockout device 100 is configured to be locked within the terminal block, thus 'locking out' any person(s) from accidentally connecting the first terminal and the second terminal, as will be discussed in detail below.

Figure 2:
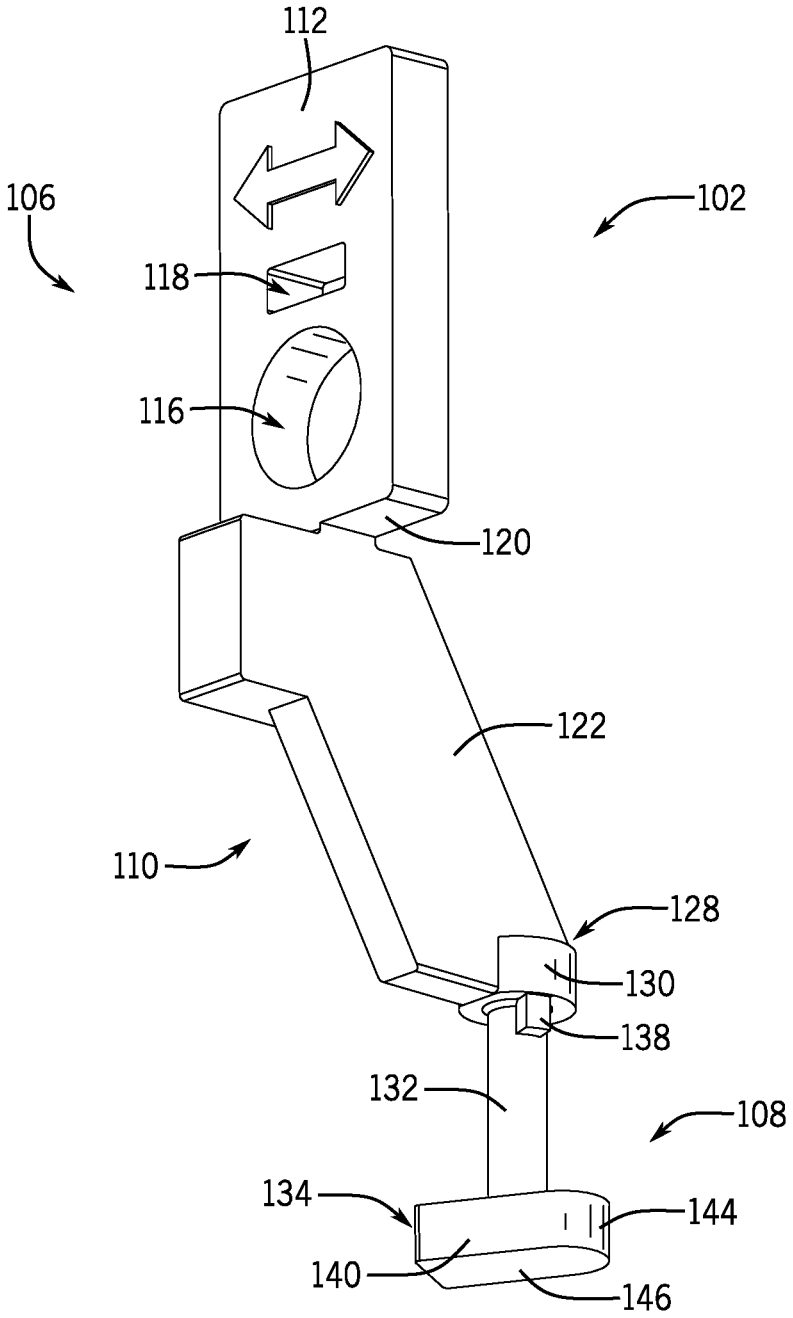
FIG. 2 is a front, bottom, right perspective view of a first lockout section of the lockout device of FIG. 1.

Referring now to FIG. 2, the first lockout section 102 includes an upper locking portion 106 and a lower hinge portion 108 connected by an extension portion 110 extending therebetween. The upper portion 106 defines a generally rectangular shape having a front surface 112 and a rear surface 114 (shown in FIG. 5), with an upper portion thickness therebetween. The upper portion 106 includes a primary lockout opening 116 and a secondary lockout opening 118, each extending through the upper portion 106, from the front surface 112 to the rear surface.

The primary lockout opening 116 is disposed proximate a lower end 120 of the upper portion 106 and defines a generally circular shape. It will be appreciated that the primary lockout opening 116 can define other shapes, such as, for example, rectangular, oval, triangular, or any other suitable shape. The secondary lockout opening 118 is disposed generally centrally on the upper portion 106, above the primary lockout opening 116. The secondary lockout opening 118 defines a generally rectangular shape. Again, it will be appreciated that the secondary lockout opening 118 can define other shapes, such as, for example, circular, oval, triangular, or any other suitable shape.

The extension portion 110 is coupled to and extends away from the lower end 120 of the first lockout section 102. From the lower end 120, the extension portion 110 extends downward and slightly rearward, terminating at and coupling to the lower portion 108. The extension portion 110 defines a generally planar element having a right surface 122 and a left surface (not shown), with an extension portion thickness therebetween. The extension portion 110 is disposed substantially perpendicular to the upper portion 106. That is, a plane formed by the right surface 122 (or the left surface) is substantially perpendicular to a plane formed by the front surface 112 (or the rear surface) of the upper portion 106.

The lower portion 108 is coupled to and extends away from a bottom rear end 128 of the extension portion 110. The lower portion 108 includes a cylindrical flange 130, a hinge rod 132, and a lockout tab 134. The cylindrical flange 130 is coupled to and is partially enveloped by the bottom rear end 128 of the extension portion 110. The hinge rod 132 extends downward from a bottom surface 136 of the cylindrical flange 130. The hinge rod 132 defines a substantially cylindrical shape and includes a hinge-rod protrusion 138, protruding radially from the hinge rod 132 adjacent the cylindrical flange 130.

The lockout tab 134 is coupled to a bottom end of the hinge rod 132. Further, the lockout tab 134 includes a pair of long side surfaces 140, a narrow side surface 142 (shown in FIG. 4), and a rounded side surface 144. The pair of long side surfaces 140 are disposed substantially parallel to one another and on opposite sides of the lockout tab 134. The narrow side surface 142 is disposed at one end of the lockout tab 134, substantially perpendicular to each of the pair of long side surfaces 140. Finally, the rounded side surface 144 is disposed at an opposite end of the lockout tab 134 relative to the narrow side surface 142.

As such, the lockout tab 134 maintains a constant horizontally-taken cross-sectional profile from a bottom surface 146 of the lockout tab 134 to a top surface 148 (shown in FIG. 1) of the lockout tab 134 that effectively has a rectangular shape with two adjacent rounded corners that collectively form a semicircle at one end of the rectangle.

The lockout tab 134 is further misaligned with respect to both the extension portion 110 and the upper portion 106. That is, a plane formed by either of the pair of long side surfaces 140 is both at an angle with respect to a plane formed by the right surface 122 (or the left surface) of the extension portion 110, and also at an angle with respect to the front surface 112 (or the rear surface) of the upper portion 106.

As illustrated, the lockout tab 134 can be disposed at an approximate forty-five degree angle from both the extension portion 110 and the upper portion 106. In some instances, the lockout tab 134 can be disposed substantially parallel to the upper portion 106 and perpendicular to the extension portion 110. In some other instances, the lockout tab 134 can be disposed at differing angles, while still being misaligned from both the extension portion 110 and the upper portion 106.

As the lockout device 100 is generally used to prevent an electrical connection between a first terminal and a second terminal on a terminal block, the first lockout section 102 may be made of an electrically insulative material, such as, for example, a polymeric material. In many instances, the electrically insulative material may also be a pliable material so that the two sections may be received together at the hinged joint under limited assembly force, but rigid enough that the upper and lower portions on a given section remain statically position with respect to one another.

Figure 3A:
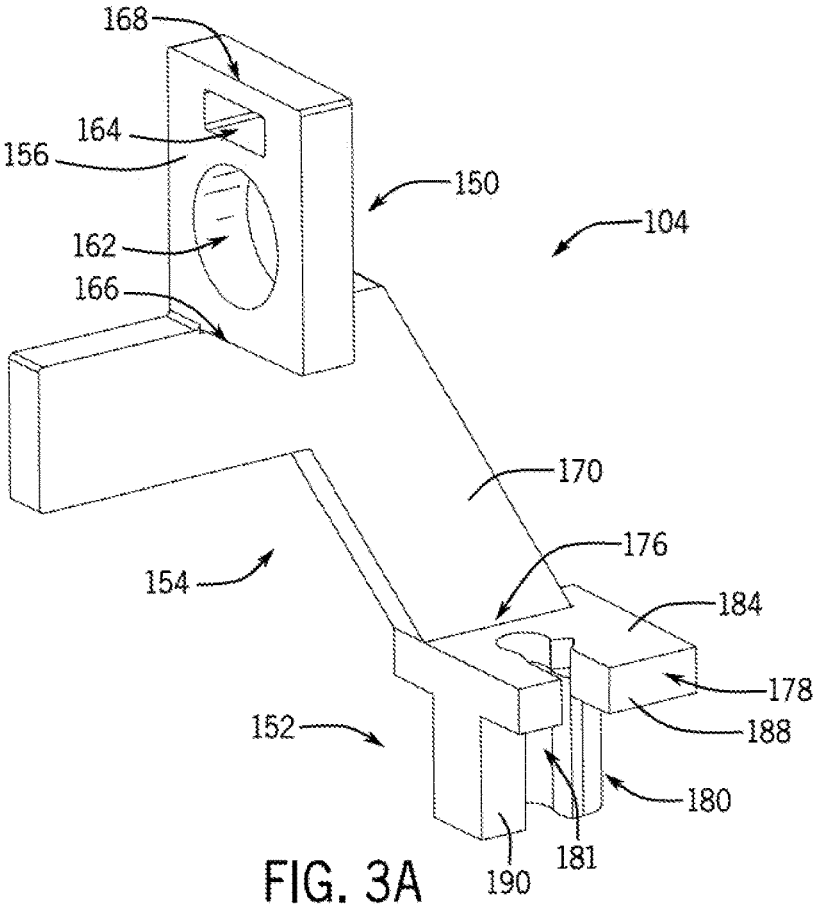
FIG. 3A is a front, top, right perspective view of a second lockout section of the lockout device of FIG. 1
Figure 3B:
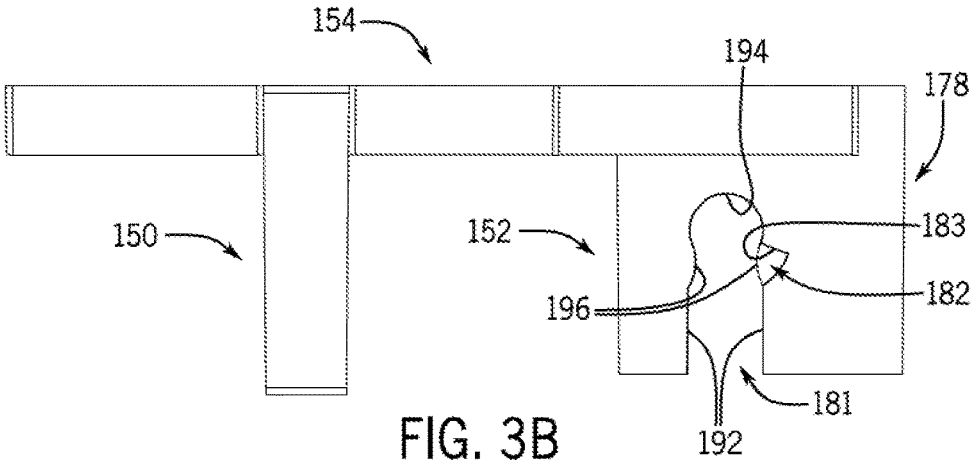
FIG. 3B is a plan view of the second lockout section of FIG. 3A.

Referring now to FIGS. 3A and 3B, the second lockout section 104 similarly includes an upper locking portion 150 and a lower hinge portion 152 connected by an extension portion 154 extending therebetween. The upper portion 150 again defines a generally rectangular shape having a front surface 156 and a rear surface (not shown), with an upper portion thickness therebetween. The upper portion 150 similarly includes a primary lockout opening 162 and a secondary lockout opening 164, each extending through the upper portion 150, from the front surface 156 to the rear surface.

The primary lockout opening 162 is disposed proximate a lower end 166 of the upper portion 150 and defines a generally circular shape. It will again be appreciated that the primary lockout opening 162 can define other shapes, such as, for example, rectangular, oval, triangular, or any other suitable shape. The secondary lockout opening 164 is disposed proximate an upper end 168 of the upper portion 150, above the primary lockout opening 162. The secondary lockout opening 164 defines a generally rectangular shape. Again, it will be appreciated that the secondary lockout opening 164 can define other shapes, such as, for example, circular, oval, triangular, or any other suitable shape.

The extension portion 154 is coupled to and extends away from the lower end 166 of the second lockout section 104. From the lower end 166, the extension portion 154 extends downward and slightly rearward, terminating at and coupling to the lower portion 152. The extension portion 154 again defines a generally planar element having a right surface 170 and a left surface (not shown), with an extension portion thickness therebetween. The extension portion 154 is similarly disposed substantially perpendicular to the upper portion 150. That is, a plane formed by the right surface 170 (or the left surface) is substantially perpendicular to a plane formed by the front surface 156 (or the rear surface) of the upper portion 150.

As alluded to above, the lower portion 152 is coupled to and extends away from a bottom end 176 of the extension portion 154. The lower portion 152 includes an upper segment 178, a lower segment 180, and a hinge-rod cutaway 181. The upper segment 178 extends horizontally away from and is coupled to the bottom end 176 of the extension portion 154. The upper segment 178 defines a substantially rectangular shape, with a portion removed therefrom by the hinge-rod cutaway 181. The upper segment 178 further includes a rotation cutout 182 having a stop wall 183. The rotation cutout 182 is configured to allow the hinge rod 132 to rotate a predetermined amount when the first lockout section 102 is coupled to the second lockout section 104, and to prevent further rotation when the hinge-rod protrusion 138 contacts the stop wall 183, as will be described below.

The upper segment 178 is also generally perpendicular to both the extension portion 154 and the upper portion 150. That is, a plane formed by either a top surface 184 or a bottom surface 185 (shown in FIG. 5) of the upper segment 178 is substantially perpendicular to both a plane formed by the right surface 170 (or the left surface) of the extension portion 154 and a plane formed by the front surface 156 (or the rear surface) of the upper portion.

The lower segment 180 extends downward from the bottom surface 185 of the upper segment 178 and maintains a constant horizontally-taken cross-sectional profile from the bottom surface 185 of the upper segment 178 to a bottom surface (not shown) of the lower segment 180. The horizontally-taken cross-sectional profile has a substantially similar shape to the horizontally-taken cross-sectional profile of the lockout tab 134 of the first lockout section 102, with a portion removed therefrom by the hinge-rod cutaway 181, as will be described below.

As best illustrated in FIG. 3B, the hinge-rod cutaway 181 extends vertically through the entire lower portion 152, cutting through a portion of each of the upper segment 178 and the lower segment 180. The hinge-rod cutaway 181 further extends horizontally inward from a right side 188 of the upper segment 178, through a portion of the upper segment 178, and further into a right side 190 of the lower segment 180.

As such, the hinge-rod cutaway 181 forms two sidewalls 192 connected by a rounded inner end 194, providing a channel-like cutaway within the lower portion 152, configured to receive the hinge rod 132 of the first lockout section 102. The hinge-rod cutaway 181 further includes a pair of opposed sidewall protrusions 196 configured to retain the hinge rod 132 within the hinge-rod cutaway 181 when the first lockout section 102 is coupled to the second lockout section 104, as will be described below.

For similar reasons as those described above, with reference to the first lockout section 102, the second lockout section 104 may be made of an electrically insulative material, such as, for example, a polymeric material. In many instances, the electrically insulative material may have similar mechanical properties to the first lockout section 102, described above.

Now that the first lockout section 102 and the second lockout section 104 have been described in detail above, the assembly and functionality of the lockout device 100 as a whole will be described below.

Figure 4:
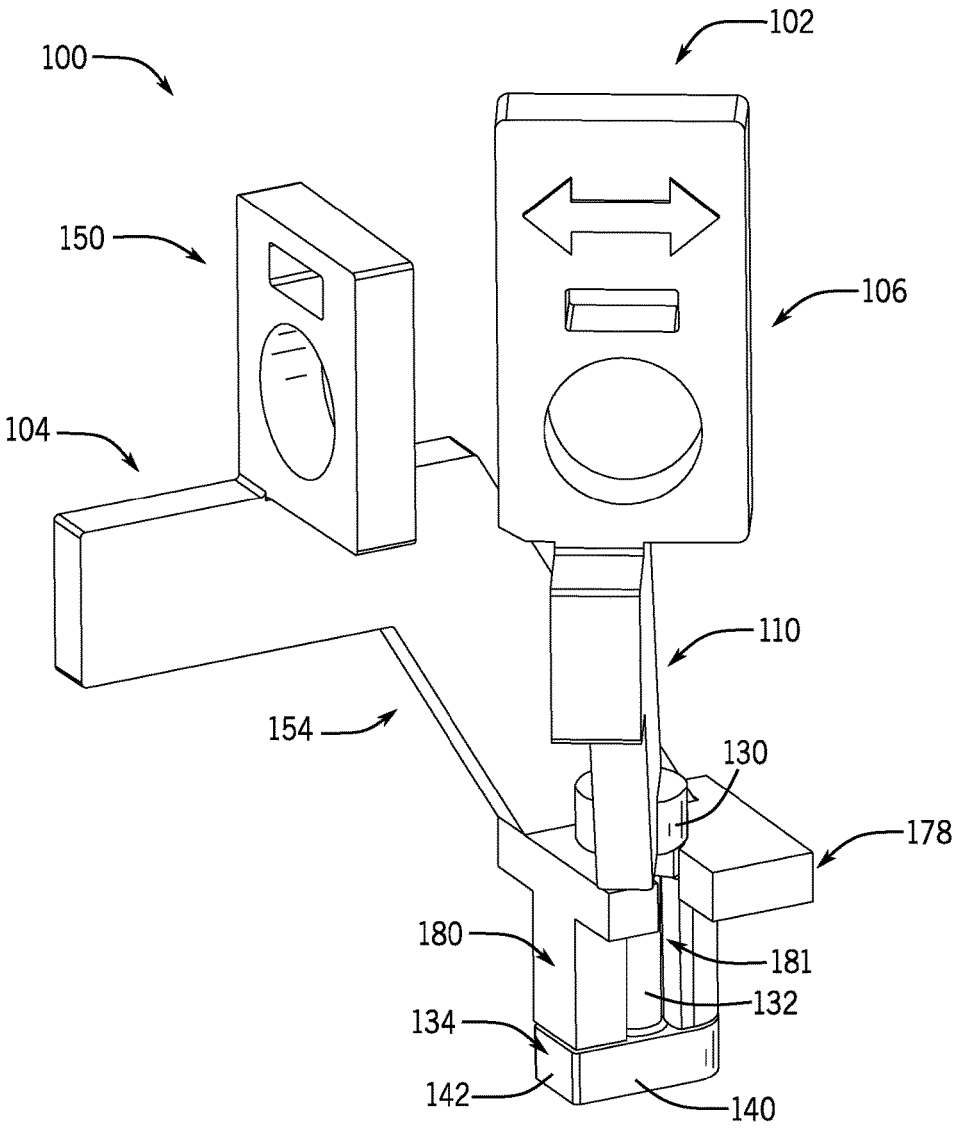
FIG. 4 is a front, top, right perspective view of the lockout device of FIG. 1, shown in a first position.
Figure 5:
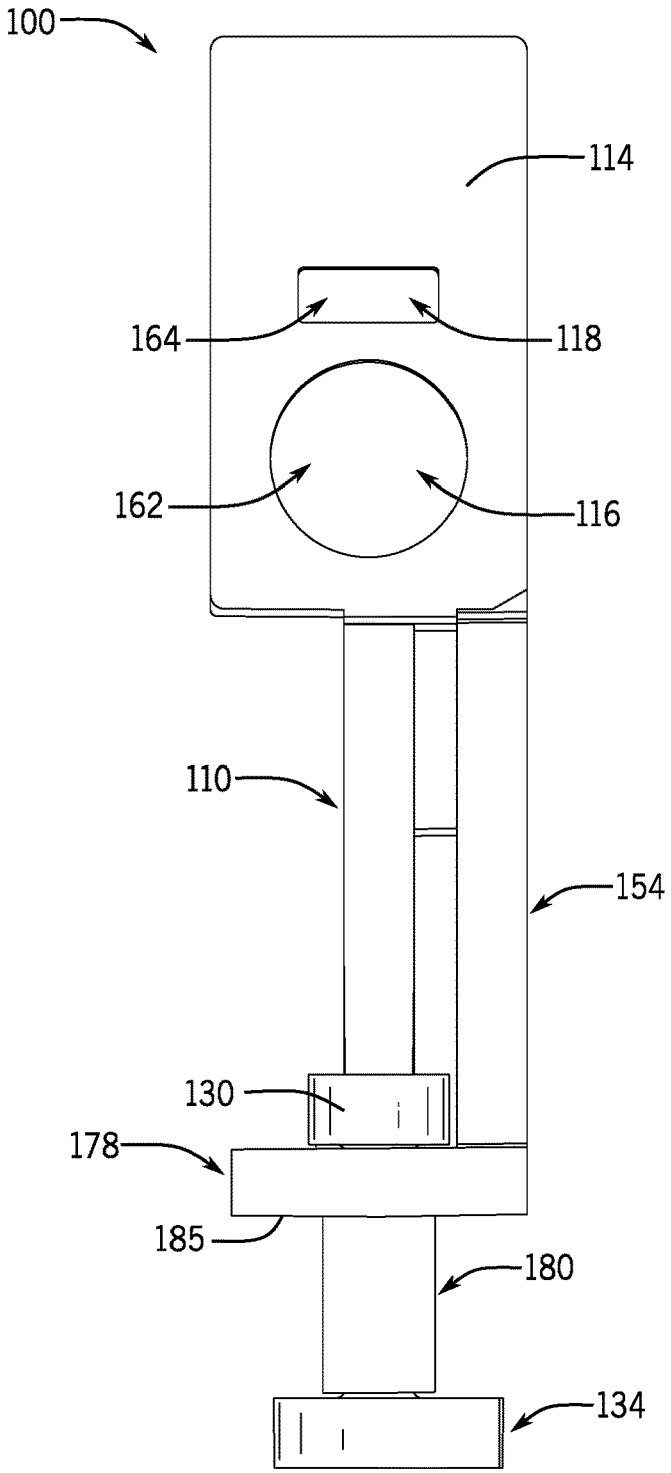
FIG. 5 is a rear elevational view of the lockout device of FIG. 1, shown in a second position.

Referring now to FIGS. 1, 4, and 5, the lockout device 100 is assembled by inserting the hinge rod 132 of the first lockout section 102 into the hinge-rod cutaway 181 of the second lockout section 104, such that the lockout tab 134 of the first lockout section 102 is disposed below the bottom surface 186 of the lower segment 180 of the second lockout section 104. While inserting the hinge rod 132 into the hinge-rod cutaway 181, when the hinge rod 132 pushes against the sidewall protrusions 196, the pliability of the second lockout section 104 allows the sidewalls 192 of the hinge-rod cutaway 181 to slightly flex away from each other, thereby providing sufficient clearance for the insertion of the hinge rod 132 into the rounded inner end 194. Once the hinge rod 132 has passed the sidewall protrusions 196, the elastic nature of the pliable material of the second lockout section 104 forces the sidewalls 192 back to their original configuration, thereby securing the hinge rod 132 within rounded inner end 194 of the hinge-rod cutaway 181.

As such, the first lockout section 102 is coupled to the second lockout section 104 by snap-fitting the hinge rod 132 of the first lockout section 104 within the hinge-rod cutaway 181 of the second lockout section 104.

Once the first lockout section 102 is coupled to the second lockout section 104, the first lockout section 102 is rotatable relative to the second lockout section 104, such that the lockout device is moveable between a first position (shown in FIG. 4) and a second position (shown in FIGS. 1 and 5).

In the first position, the first lockout section 102 is rotated with respect to the second lockout section 104, such that the upper portion 106 and the extension portion 110 of the first lockout section 102 are rotated away from the upper portion 150 and the extension portion 154 of the second lockout section 104. As such, in the first position, the lockout tab 134 of the first lockout section 102 is aligned with the lower segment 180 of the second lockout section 104. Said differently, in the first position, the horizontally-taken cross-sectional profile of the lockout tab 134, is generally aligned with the substantially similar horizontally-taken cross-sectional profile of the lower segment 180, such that they share a similar outer periphery as viewed along the vertical axial direction.

In the second position, the first lockout section 102 is rotated with respect to the second lockout section 104, such that the upper portion 106 and the extension portion 110 of the first lockout section 102 are rotated into one of contact and proximity with the upper portion 150 and the extension portion 154 of the second lockout section 104. As such, in the second position, the primary lockout opening 116 and the secondary lockout opening 118 of the first lockout section 102 are aligned with the primary lockout opening 162 and the secondary lockout opening 164 of the second lockout section 104. Further, in the second position, the lockout tab 134 of the first lockout section 102 is misaligned with the lower segment 180 of the second lockout section 104, as best illustrated in FIG. 5.

Additionally, while rotating the lockout device 100 between the first position and the second position, the rotation cutout 182 of the upper segment 178 provides sufficient clearance for the hinge-rod protrusion 138 to rotate with the hinge rod 132 between the first position and the second position. However, while rotating the lockout device 100 from the second position to the first position, the rotation cutout 182 can be configured to prevent the lockout device 100 from being rotated past the first position, such that the lockout tab 134 of the first lockout section 102 and the lower segment 180 of the second lockout section 104 are aligned when the hinge-rod protrusion 138 contacts the stop wall 183 of the rotation cutout 182.

Now that the assembly and functionality of the lockout device 100 have been described above, an exemplary method of use for the lockout device 100 will be described below. It will be appreciated that the method described below is provided as an example and is not meant to be limiting. Further, the lockout device 100 will be described below in use with a terminal block. As such, a brief description of the functionality of the terminal block will be provided as well.

Figure 6A:
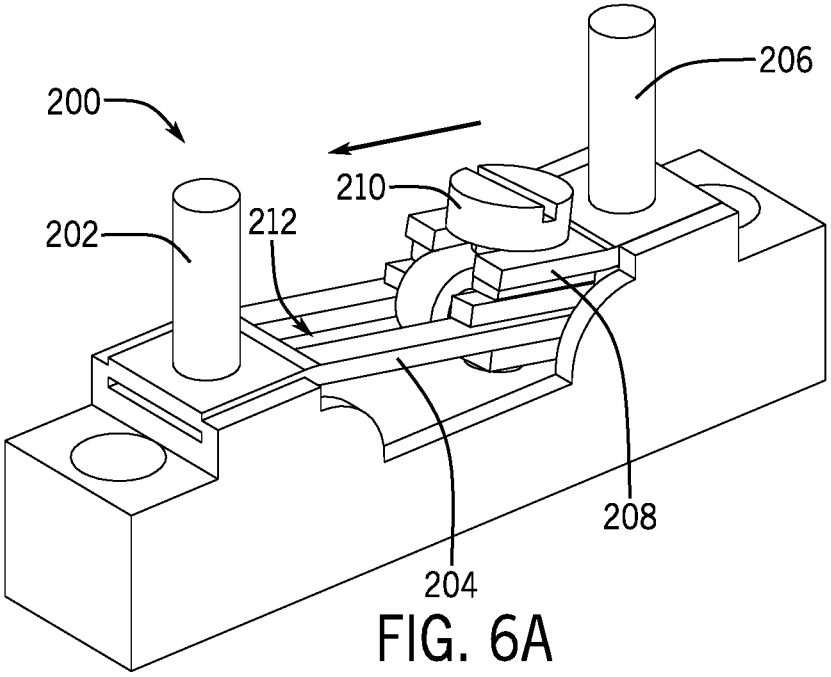
FIG. 6A is a front, top, right perspective view of a terminal block, shown in a closed position.
Figure 6B:
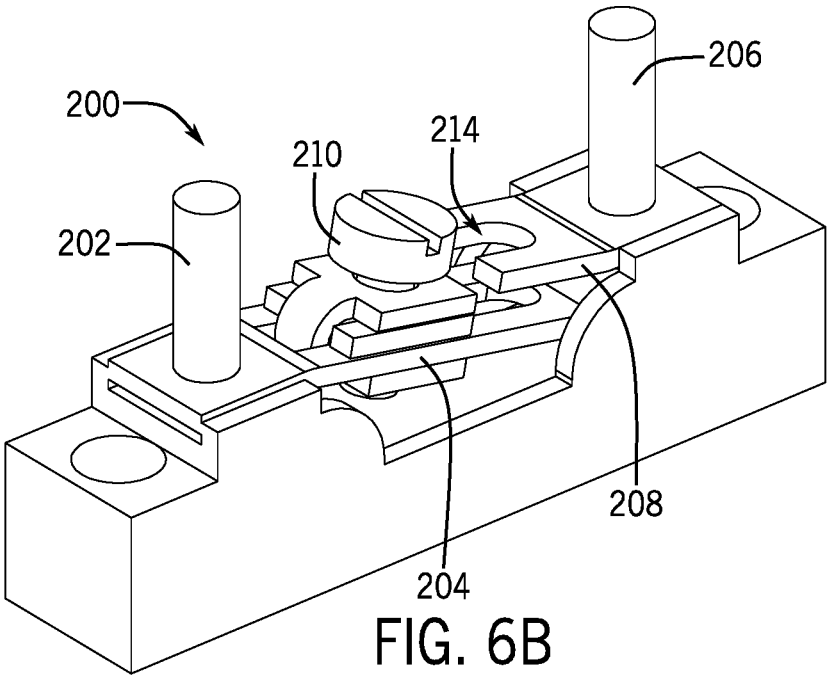
FIG. 6B is a front, top, right perspective view of the terminal block of 6A, shown in an open position.

Referring now to FIGS. 6A and 6B, a terminal block 200 is illustrated. The terminal block 200 includes a first terminal 202, a first terminal slide 204, a second terminal 206, a second terminal port 208, and a slide connector 210. The first terminal 202 is electrically connected to the first terminal slide 204. The second terminal 206 is electrically connected to the second terminal port 208. The slide connector 210 is electrically conductive, and is therefore configured to selectively connect the first terminal slide 204, and thereby the first terminal 202, to the second terminal port 208, and thereby to the second terminal 206. As such, the terminal block 200 is movable between a closed position (shown in FIG. 6A), in which the first terminal 202 is electrically connected to the second terminal 206, and an open position (shown in FIG. 6B), in which the first terminal 202 is disconnected from the second terminal 206.

In the closed position, the slide connector 210 is slid within a slot 212 of the first terminal slide 204 into a receiving cutaway 214 of the second terminal port 208, such that the slide connector 210 contacts both the first terminal slide 204 and the second terminal port 208, thereby electrically connecting the first terminal 202 to the second terminal 206.

In the open position, the slide connector 201 is slid within the slot 212 of the first terminal slide 204 out of the receiving cutaway 214 of the second terminal port 208, such that the slide connector 210 no longer contacts the second terminal port 208, thereby electrically disconnecting the first terminal 202 from the second terminal 206.

Figure 7A:
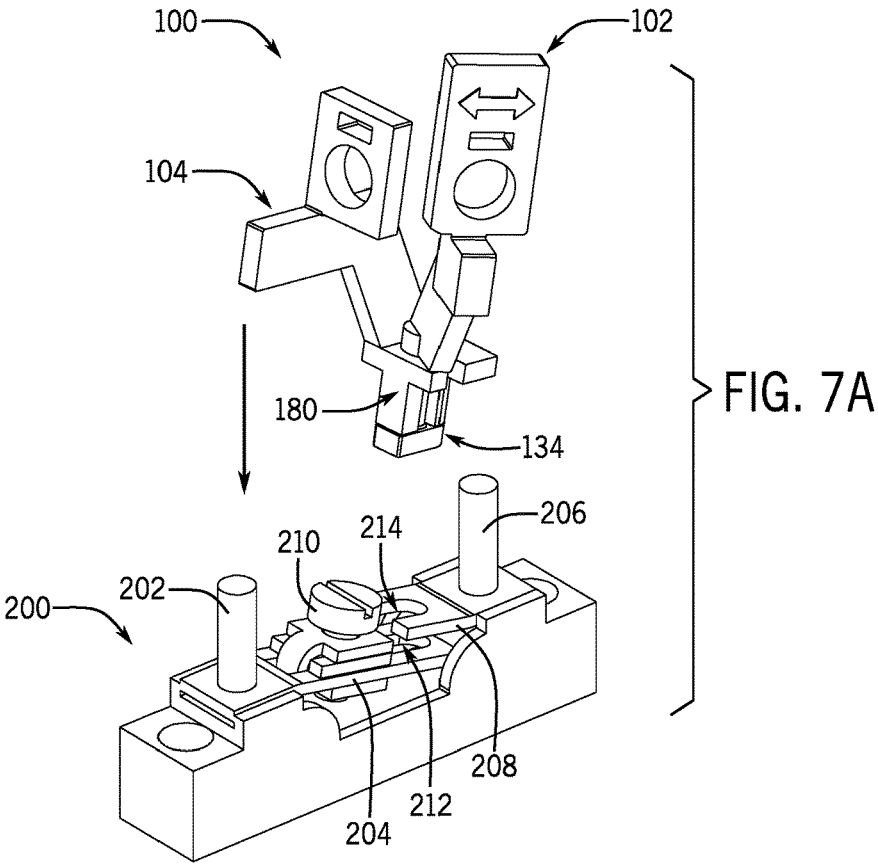
FIG. 7A is a front, top, right perspective view of the lockout device of FIG. 1, shown in the first position, such that the lockout device may be inserted into the open terminal block of FIG. 6B.
Figure 7B:
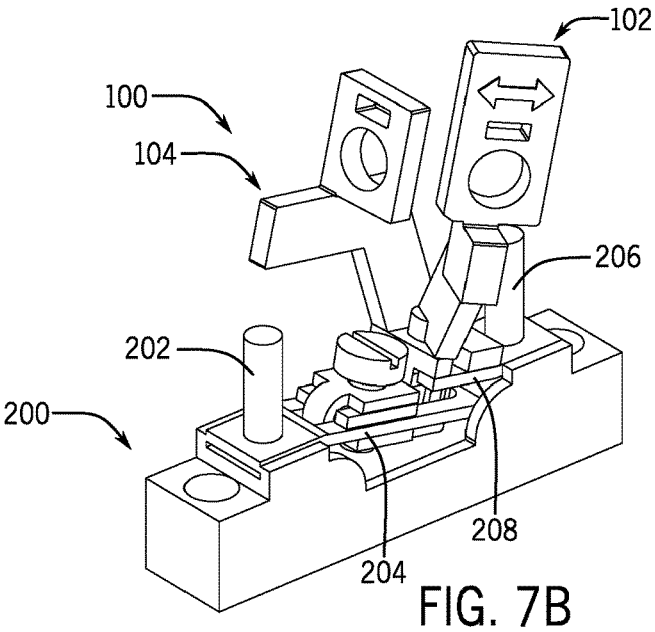
FIG. 7B is a front, top, right perspective view of the lockout device of FIG. 1, shown in the first position and inserted into the open terminal block of FIG. 6B.

Referring now to FIGS. 7A and 7B, in use, the lockout device 100 may initially be rotated into the first position, such that the lockout tab 134 of the first lockout section 102 is aligned with the lower segment 180 of the second lockout section 104, and the terminal block 200 may be moved into the open position, as shown in FIG. 7A. With the lockout device 100 in the first position, and the terminal block 200 in the open position, the lockout device 100 can be inserted into the terminal block 200, with the lockout tab 134 and the lower segment 180 being inserted through the receiving cutaway 214 of the second terminal port 208, and further through a space within the slot 212 of the first terminal slide 204. With the lockout device 100 inserted into the terminal block 200, the slide connector 210 is effectively prevented from being slid back into contact with the second terminal port 208, thereby preventing the terminal block 200 from being moved back into the closed position.

Figure 8:
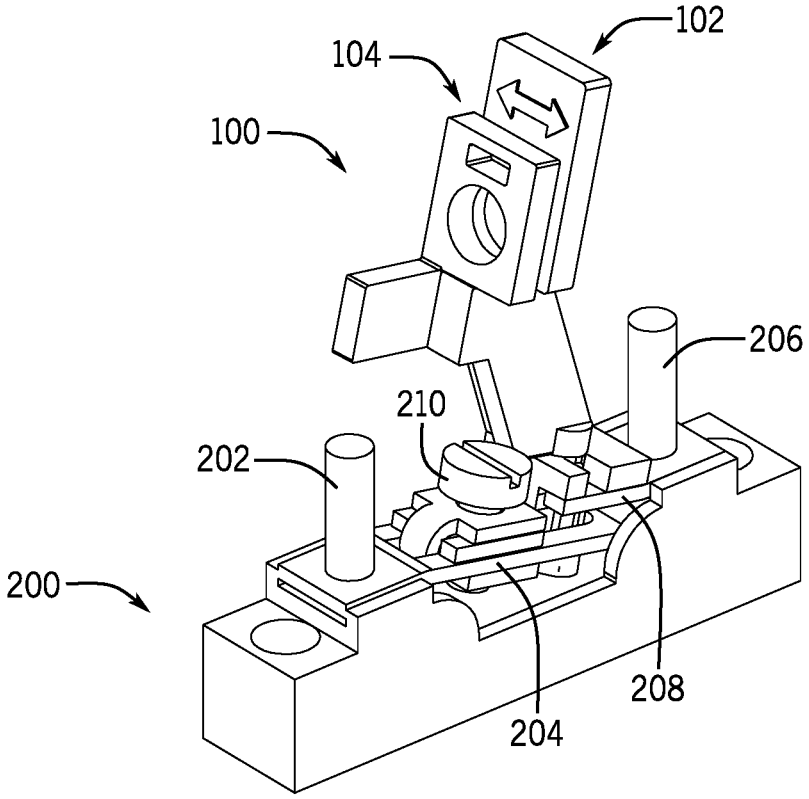
FIG. 8 is a front, top, right perspective view of the lockout device of FIG. 1, shown in the second position, while inserted into the open terminal block of FIG. 6B.

Referring now to FIG. 8, once the lockout device 100 has been inserted into the terminal block 200, the lockout device 100 can be rotated into the second position. When the lockout device 100 is rotated into the second position, the lockout tab 134 of the first lockout section 102 moves out of alignment with the lower segment 180 of the second lockout section 104, and a portion of the lockout tab 134 is therefore disposed directly beneath a solid portion of the first terminal slide 204. As such, in the second position, the lockout device 100 is prevented from being removed from the terminal block 200.

Figure 9:
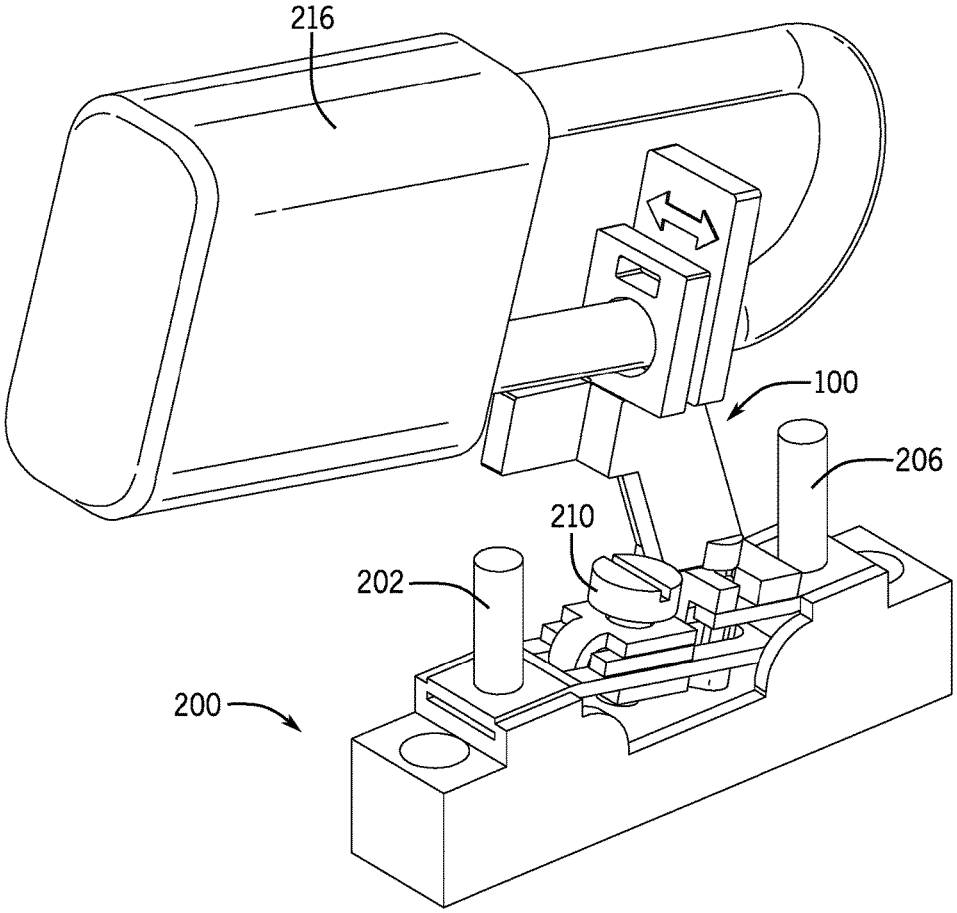
FIG. 9 is a front, top, right perspective view of the lockout device of FIG. 1, shown in the second position, while inserted into the open terminal block of FIG. 6B, and with a lock inserted into the lockout device.

Referring now to FIG. 9, with the lockout device 100 inserted into the terminal block 200 and moved into the second position, a lock 216 can be inserted through the aligned primary lockout openings 116, 162 of the first and second lockout sections 102, 104, thereby effectively locking the lockout device 100 within the terminal block 200. With the lockout device 100 locked within the terminal block 200, the terminal block 200 is prevented from being moved into the closed position, thereby effectively locking out or preventing the first terminal 202 of the terminal block 200 from being electrically connected to the second terminal 206 of the terminal block 200.

In some instances, alternatively or in addition to the lock being inserted through the aligned primary lockout openings 116, 162, an additional lock, spring-clip, or any other suitable temporary coupling element may be inserted through the aligned secondary lockout openings 118, 164 of the first and second lockout sections 102, 104, thereby temporarily locking the lockout device 100 within the terminal block 200.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A lockout device configured to prevent connection between a pair of terminals of a terminal block by insertion into a space of the terminal block when the terminal block is opened, the lockout device comprising:

a pair of sections rotatably coupled to one another in which each of the sections has an upper portion including a corresponding lockout opening and a lower portion for selective reception into the space of the terminal block in an open position;

wherein, the pair of sections are rotatable between an opened position and a closed position in which, in the opened position, the upper portions are misaligned and the lower portions are aligned to permit at least a portion of the lower portions to be inserted into an opening between the terminal block while opened and in which, in the closed position, the lockout openings of the upper portions are aligned to accommodate reception of a lock in the lockout openings to prevent movement away from the closed position and the lower portions are misaligned to prevent removal of the lockout device from the opening in the terminal block.

2. The lockout device of claim 1, wherein each of the pair of sections includes a corresponding secondary lockout opening.

3. The lockout device of claim 2, wherein, in the closed position, the secondary lockout openings are aligned.

4. The lockout device of claim 1, wherein one of the pair of sections includes a hinge rod, the other of the pair of sections includes a hinge-rod cutaway, and the pair of sections are coupled together by snap-fitting the hinge rod within the hinge-rod cutaway.

5. The lockout device of claim 4, wherein the hinge rod includes a hinge-rod protrusion, the other of the pair of sections further includes a rotation cutout having a stop wall, and the rotation cutout is configured to allow a predetermined amount of rotation of the hinge rod, and the stop wall is configured to prevent additional rotation of the hinge rod when the hinge-rod protrusion contacts the stop wall.

6. The lockout device of claim 5, wherein when the hinge-rod protrusion contacts the stop wall, the pair of sections are in the opened position.

7. The lockout device of claim 1, wherein the upper portions of the pair of sections are on one axial end of the lockout device and the lower portions of the pair of sections are on the other axial end of the lockout device.

8. The lockout device of claim 1, wherein each of the lower portions have a profile perpendicular to an axis of rotatable coupling of the pair of sections in which the respective profiles match in shape and size in the opened position.

9. The lockout device of claim 8, wherein the respective profiles of the lower portions are matchable in shape and size in the opened position at an axial position between the pair of lower portions.

10. The lockout device of claim 8, wherein the respective profiles of the lower portions are elongated.

11. The lockout device of claim 1, wherein one of the two lower portions is on an axial end and the other is positioned axially adjacent to this lower portion.

12. The lockout device of claim 1, wherein the upper portion of each of the pair of sections is fixed in space relative to the respective lower portion of that section.

13. A method of preventing connection of a pair of terminals of a terminal block when the terminal block is opened using a lockout device, the method comprising:

rotating one of a pair of sections of the lockout device relative to another one of the sections such that respective lower portions of each of the sections are aligned and respective upper portions of each of the sections are misaligned;

inserting the aligned lower portions of the lockout device into a space of the terminal block when the terminal block is opened, thereby preventing the connection of the pair of terminals;

rotating the pair of sections relative to one another such that lower portions are misaligned with one another and the respective lockout openings in respective upper portions of each of the pair of sections are aligned with one another to accommodate reception of a lock through the respective pair of lockout openings, thereby preventing the lockout device from being withdrawn from the space in the terminal block due to misalignment of the lower portions.

14. The method of claim 13, further comprising inserting a lock through both of the aligned lockout openings, thereby locking the lower portions in a misaligned state relative to one another and preventing rotation of the pair of sections relative to one another.

* * * * *